US010561905B2

(12) United States Patent
York et al.

(10) Patent No.: US 10,561,905 B2
(45) Date of Patent: Feb. 18, 2020

(54) OVAL FOOTBALL RECEIVING AND LAUNCHING MACHINE AND METHOD

(71) Applicants: Michael Timothy York, New Kensington, PA (US); Dennis Henry Skvarce, South Lyon, MI (US)

(72) Inventors: Michael Timothy York, New Kensington, PA (US); Dennis Henry Skvarce, South Lyon, MI (US)

( * ) Notice: Subject to any disclaimer, the term of this patent is extended or adjusted under 35 U.S.C. 154(b) by 0 days.

(21) Appl. No.: 15/168,073

(22) Filed: May 29, 2016

(65) Prior Publication Data

US 2017/0326414 A1 Nov. 16, 2017

Related U.S. Application Data

(60) Provisional application No. 62/230,939, filed on Jun. 19, 2015.

(51) Int. Cl.

| | |
|---|---|
| ***A63B 47/00*** | (2006.01) |
| ***A63B 69/40*** | (2006.01) |
| ***A63B 63/08*** | (2006.01) |
| ***A63B 63/00*** | (2006.01) |

(52) U.S. Cl.

CPC ..... *A63B 47/002* (2013.01); *A63B 63/08* (2013.01); *A63B 69/406* (2013.01); *A63B 2063/001* (2013.01); *A63B 2069/402* (2013.01); *A63B 2243/007* (2013.01)

(58) Field of Classification Search

CPC ..... A63B 47/002; A63B 69/406; A63B 2069/402; A63B 2243/007

See application file for complete search history.

(56) References Cited

U.S. PATENT DOCUMENTS

| | | | | |
|---|---|---|---|---|
| 3,977,386 | A | 8/1976 | Meyer | |
| 4,026,261 | A | 5/1977 | Paulson et al. | |
| 4,714,248 | A | 12/1987 | Koss | |
| 4,723,532 | A * | 2/1988 | Osojnak | A63B 69/406 124/48 |
| 4,772,017 | A | 9/1988 | Erikson | |
| 5,417,196 | A | 5/1995 | Morrison et al. | |
| 5,487,540 | A | 1/1996 | Bixler et al. | |
| 5,776,018 | A | 7/1998 | Simpson et al. | |
| 6,241,628 | B1 | 6/2001 | Jenkins et al. | |
| 6,616,555 | B2 | 9/2003 | Bewley | |
| 6,877,501 | B2 | 4/2005 | Wojtkiewicz et al. | |
| 7,137,910 | B2 | 11/2006 | Ktson et al. | |
| 7,553,244 | B2 | 6/2009 | York | |
| 7,708,003 | B1 * | 5/2010 | Gavieres | A63B 47/002 124/78 |
| 8,932,156 | B2 | 1/2015 | Beohner | |
| 9,022,016 | B1 * | 5/2015 | Hafer | F41B 4/00 124/6 |
| 9,050,520 | B2 | 6/2015 | Lu | |
| 2007/0149326 | A1 * | 6/2007 | York | A63B 47/002 473/438 |
| 2013/0109510 | A1 | 5/2013 | Boehner | |
| 2014/0261363 | A1 | 9/2014 | Lu | |

* cited by examiner

*Primary Examiner* — Jeffrey S Vanderveen

(74) *Attorney, Agent, or Firm* — Michael T. York

(57) ABSTRACT

What is provided is a football catching and throwing machine and method that includes an inclined upwardly angled path. The machine includes a collector configured to receive a football thrown into it; a ball translator configured to align the football and transport the football up the inclined path to a football accelerator that launches the football into the air; and a motor that operates the football accelerator.

12 Claims, 18 Drawing Sheets

OVAL FOOTBALL RECEIVING AND LAUNCHING MACHINE AND METHOD

This application claims the benefit of PPA Ser. Nr. (Application Nr.) 62/230,939, filed on Jun. 19, 2015 by the present inventors, which is incorporated by reference.

TECHNICAL FIELD

The application relates generally to a machine that is designed to receive oval footballs that are thrown into it, orient them and to throw or launch them back to the user automatically.

SUMMARY

What is provided is a football catching and throwing machine and method that includes an inclined upwardly angled path. The machine includes a collector that receives a football thrown into it; a ball translator the aligns the football and transports the football up the inclined path to a football accelerator that launches the football into the air; and a motor that operates the football accelerator. The machine may include one or more ball guides in proximity to the inclined path that adjust the orientation of the football as it travels along the inclined path to the ball accelerator, to reduce or prevent misalignment of the ball when entering the accelerator. It includes a spread support system configured to support the belly of the football as it travels up the inclined path that is configured to align the football.

BRIEF DESCRIPTION OF THE DRAWINGS

Referring to the exemplary drawings wherein like elements are numbered alike in the accompanying Figures.

DETAILED DESCRIPTION

Figure 1:
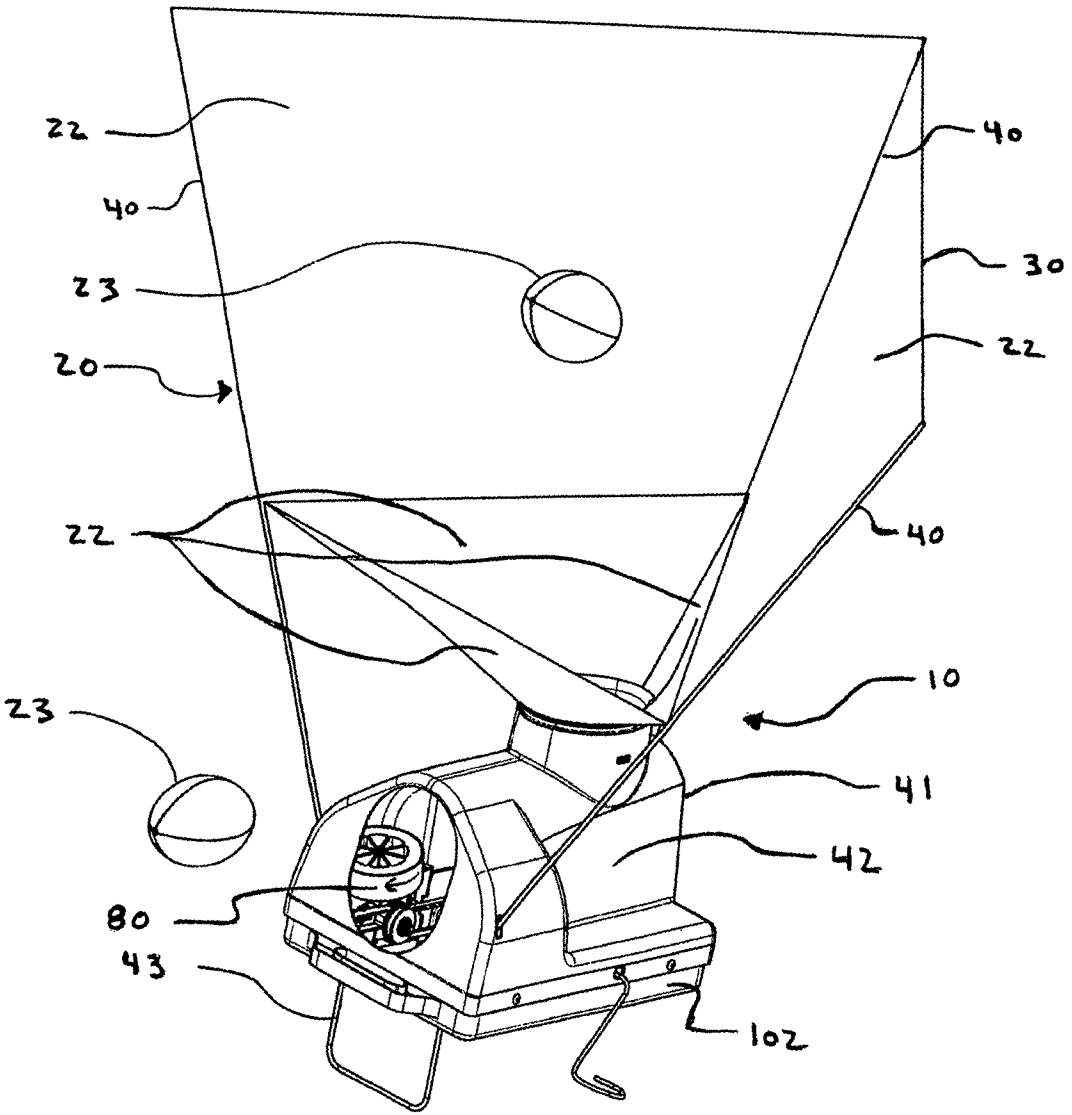
FIG. 1 is a front-side perspective view of a first example of the oval football receiving and launching machine.
Figure 2:
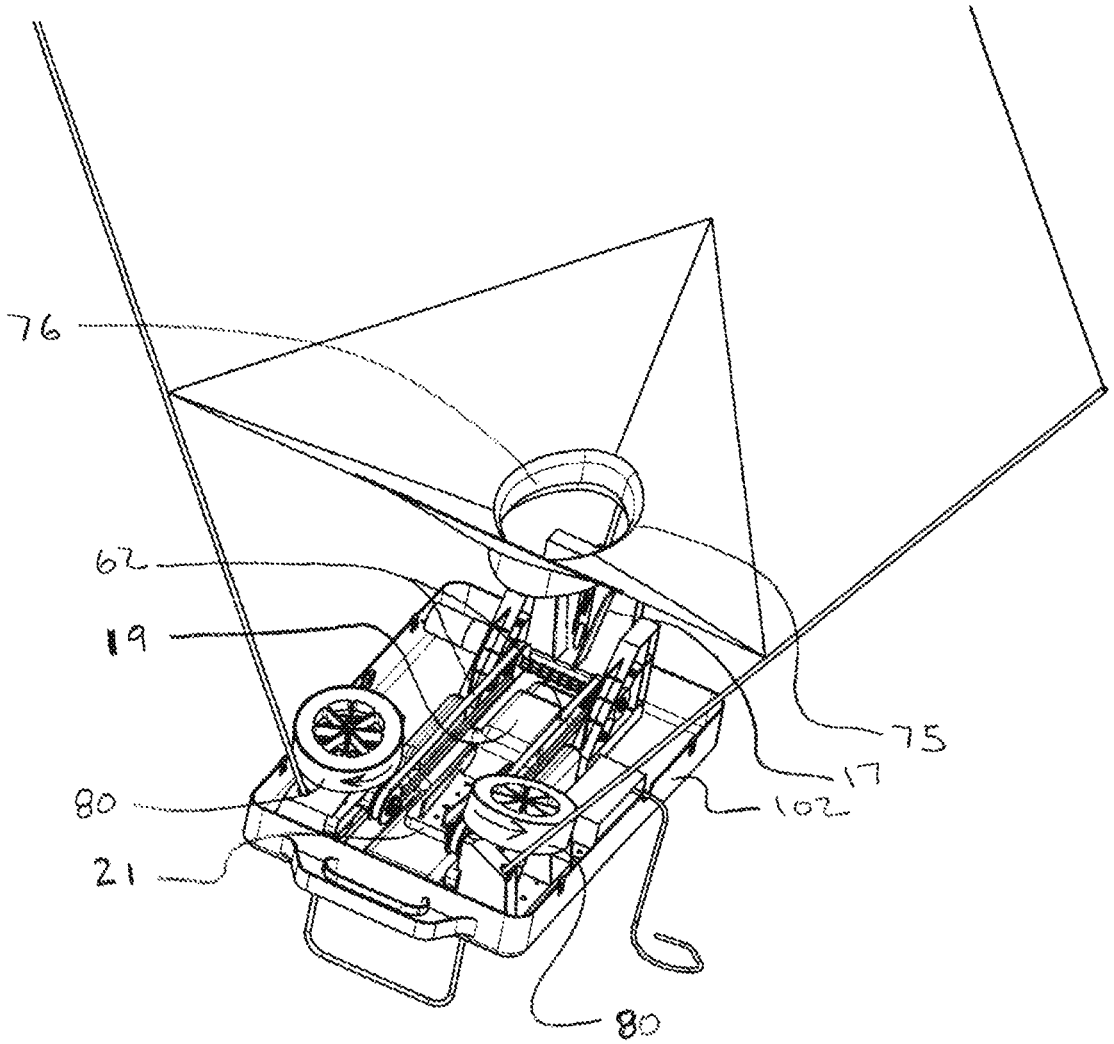
FIG. 2 is a front-side perspective view of the first example of the oval football receiving and launching machine with the cover omitted to show the mechanical features underneath the cover.
Figure 3:
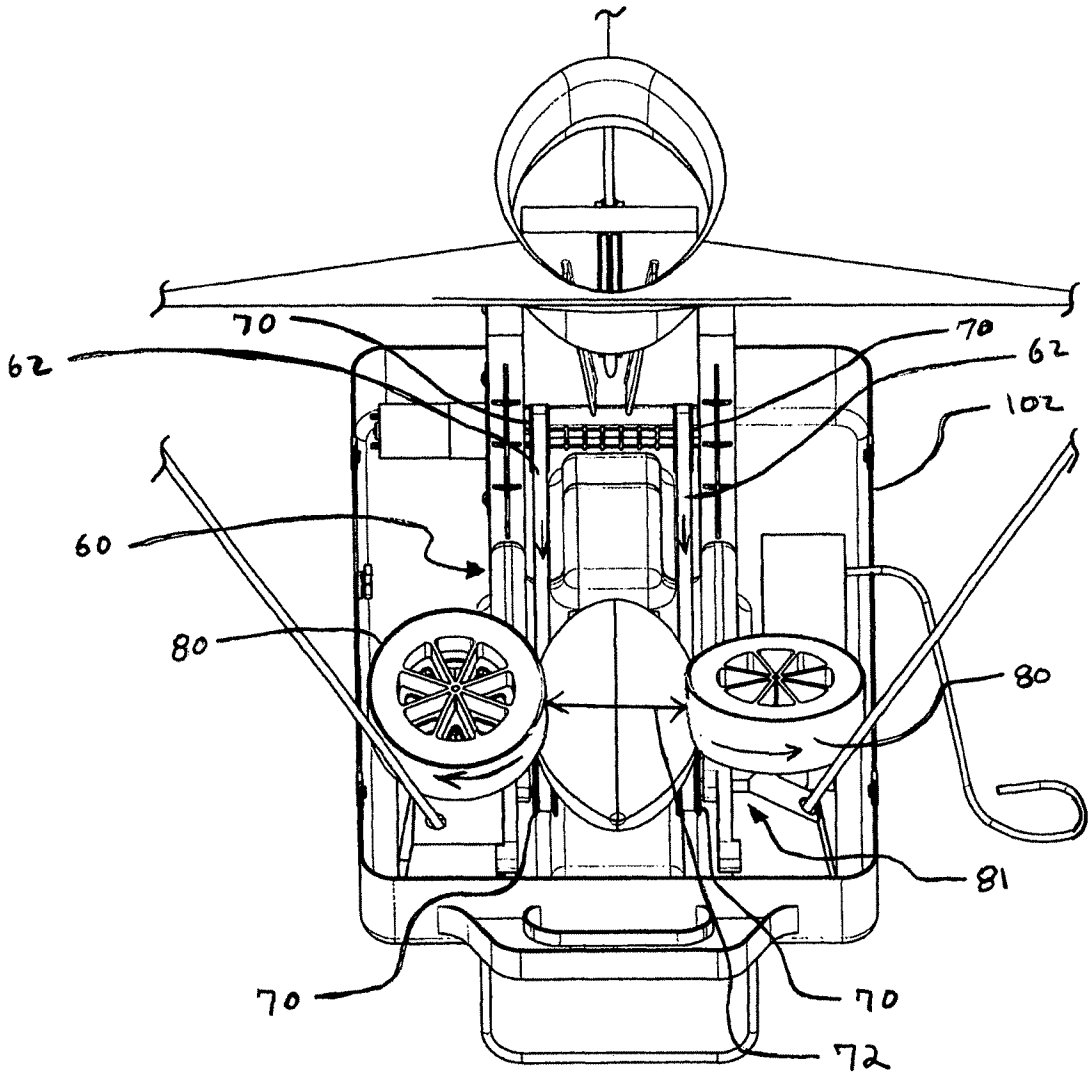
FIG. 3 is a front-top perspective view of the first example of the oval the oval football receiving and launching machine with the cover omitted to show the mechanical features underneath the cover and a football squeezed between the launch wheels.

Referring now to FIG. 1 which illustrates a first example as presently contemplated, a launcher 10 for receiving and launching an oval football 23. As can be seen in FIG. 1, launcher 10 contains a collector 20 for receiving thrown footballs and guiding them into a translator 60, best seen in FIG. 3, that advances the football forward between spinning wheels 80 that are part of a ball accelerator 81, best seen in FIG. 3, to accelerate and launch oval footballs 23 into the air. Wheels 80 are preferably made from rubber or plastic material that has a relatively high coefficient of friction between the surfaces of the wheels and the football. However, metal wheels or rigid plastic wheels could also be used. The collector, the translator and the accelerator are supported by a base 102. Translator 60 includes belts 62 strung over front pulleys 70F and rear pulleys 70R. The rear pulleys are integrated as part of rear shaft 69, as shown in FIG. 3. The rear shaft and pulleys are contemplated as being made from molded polymer, as for example nylon. The rear shaft is connected to side brackets 68 through bearings (not shown) contained within the side brackets. The side brackets are mounted to base 102 using fasteners that pass through the base and thread into the side brackets. The side brackets are contemplated as being made from molded plastic, as for example nylon. The function of the side brackets is to support the rear shaft to enable the rear shaft to rotate to provide a linear velocity to the surface of belts 62. The base is constructed from relatively rigid material as for example molded plastic or stamped sheet metal. Base 102 serves as a structural foundation on which other component are mounted. A stand 43 is connected to base 102 and provides for the elevation of the front of the base. The stand can be made from a variety of rigid materials and connected to the base in a variety of ways that are commonly used connection techniques. As contemplated in the first example, the base is generally relatively thin walled semi-rigid polymer structure. Many other variations to the geometry and material for the base are possible. As for example, base 102 could be replaced by a series of welded metal plates or beam members. It could be constructed from a wood structure. The base could be replaced by multiple bases or a support structure that would perform the same structural support function as base 102.

Collector 20, shown in FIG. 1, includes a net 30 that is supported by rods 31 along the outer boundary of the net forming a net support structure. The net can be made from any type of netting material, as for example polyamide strands. The net is used to absorb the impact of a thrown football minimizing rebounding of the oval football and allowing the oval football to fall onto translator 60. Rods 31 supports the net and are preferably made out of rigid material, as for example metal, plastic or fiberglass tubing, and can be made up of an assembly of several parts, such as short sections of tubes that fit together to make up the rods. The front rods are secured to ball accelerator 81 by inserting the ends of the rods into holes 82 in the ball accelerator, as shown best shown in FIG. 3. Ball accelerator 81 is secured to base 102 using fasteners that pass through the bottom of the base and into the components of the ball accelerator. The rear rod is secured to a bracket 18, shown in FIG. 4, by inserting the rod into a rear bracket hole 83, best seen in FIG. 5. Rods 31 slide into pockets sewn into the edges of the net. The sewn pockets are not described in detail since this practice is common in net manufacturing and can take on many different styles and designs.

It is to be understood that other materials and constructions could be used instead of net 30 and rods 31 that would perform substantially the same function of absorbing a thrown football's energy and guiding the football to ball translator 60. For example, the netting could be replaced by thin sheeting of material or flexible plastic.

Figure 11:
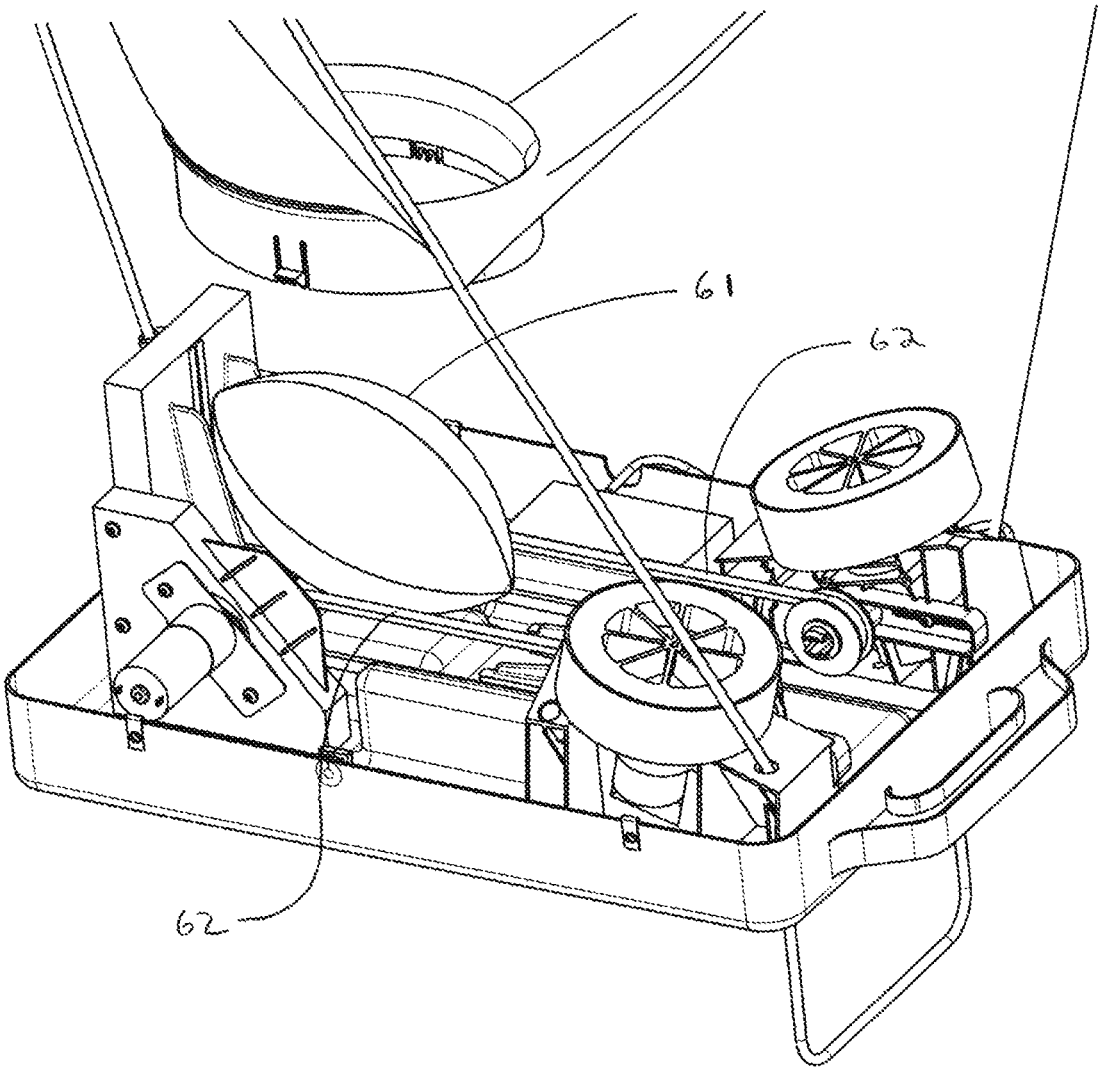
FIG. 11 is a side perspective view of the first example of the oval football receiving and launching machine with the cover omitted to show a football in a first position on the belts.

As shown in FIG. 1, collector 20 has a partially open front to allow the oval football to be thrown into the collector. The collector is shaped to guide the falling football down to belts 62, shown in FIG. 6. The collector has sloped slides that converge toward each other guiding the football to an opening 75, best shown in FIG. 1. Ball collector 20 is shown as a triangular structure, but it may have many different shapes that would work equally as well. When the oval football falls from the top of collector 20 and drops toward the bottom of the collector, it is guided to opening 75 by sidewalls 22 and travels through a chute 76 and falls on belts 62 of translator 60, shown as a first position 61 in FIG. 5. Opening 75 is contemplated as being oval shaped in the first example, however, it should be understood that the opening can also be round or other shapes since it is not required to conform closely to the shape of the ball. The opening is made up of the bottom of net 30 and can be sewn into the desired shape. As shown best in FIG. 11, a net ring 32, that is contemplated as being made of plastic or other rigid material, may be used to help shape the bottom of the net. Net 30 is attached to net ring 32 by sewing, which is a common connection means and therefore will not be described in detail. The ring has connection snaps 33, best seen in FIG. 11, that engage snap holes 44 on a cover 41, best shown in FIG. 1. In this way, the net ring can be sewn to the bottom of net 30 and the net ring can be quickly attached and detached onto and off of cover 41 to quickly setup and take down the net. Cover 41 is contemplated as being a thin-walled molded polymer structure that forms a shell, hood or cover over some of the mechanisms of launcher 10. The cover is designed to prevent incidental contact with moving parts, provide side-to-side guide walls for the football while it is being transported from first position 61 to ball accelerator 81. The cover also provides a structural member for the bottom portion of collector 20 to be attached. The cover is secured to base 102 using a plurality of fasteners 39 that pass through the cover and secure to base 102, best seen in FIG. 1. There are many materials that would work for the cover including polypropylene, nylon and other thermoplastics. Alternatively, the cover could be made from stamped metal.

Figure 9:
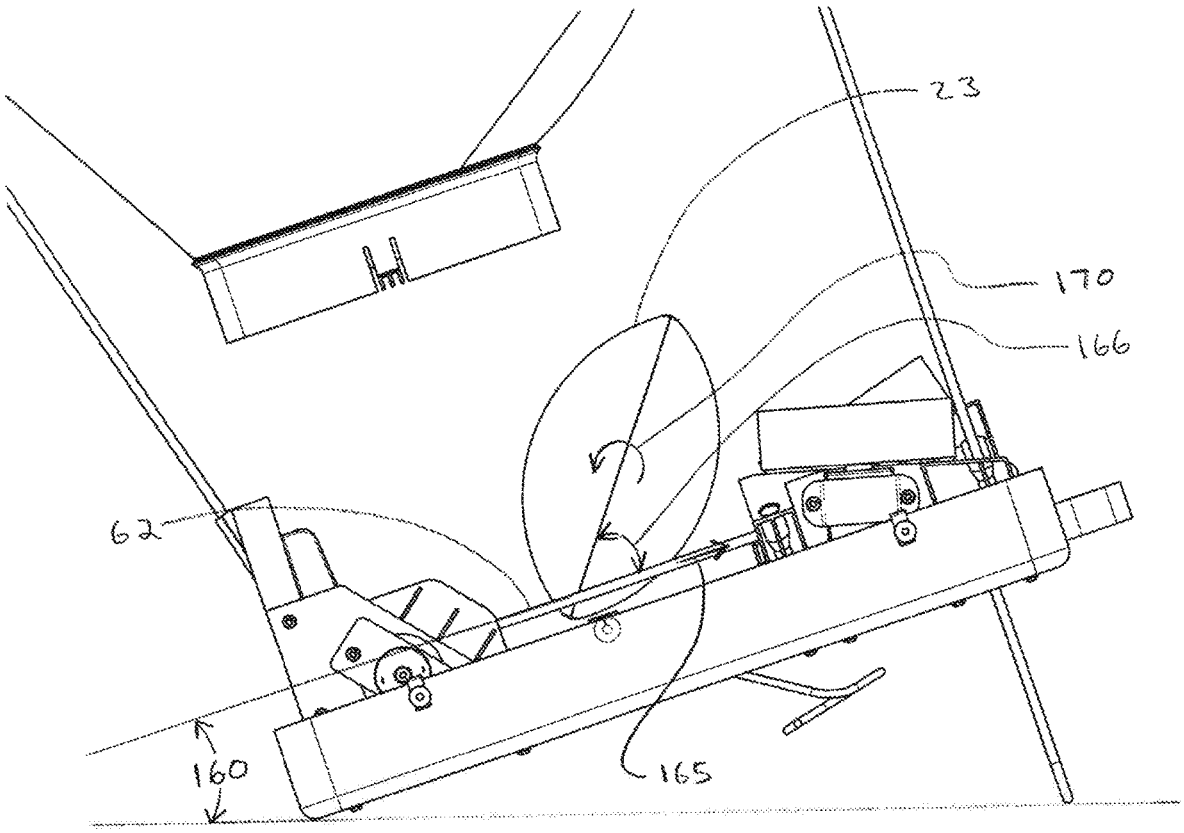
FIG. 9 is a side view of the first example of the oval football receiving and launching machine with the cover omitted to show the moments on a miss-aligned football in the machine.

Wheels 80 spin in the direction shown in FIG. 3 and are supported by wheel shafts 79. Shafts 79 extend from electric wheel motors 110, best seen in FIGS. 9 and 11. The wheel motors are mounted to support blocks 86, best seen in FIGS. 3 and 9. Motor brackets 111, best seen in FIG. 9, are shaped to cup wheel motors 110 and secure them to support blocks 86 using bracket fasteners 112. The motor brackets are contemplated to be made from stamped metal, however, other types of brackets could work as well. For example, the brackets could be molded plastic. The support blocks are fastened to base 102 using fasteners that pass through the base and connect to the support blocks. It is currently contemplated that support blocks 86 would be made from molded polymer, however, other materials and processes to make rigid support blocks could be used. As for example, the support blocks could be cast, stamped or welded metal. The wheels are fixed to the shafts so that the shafts and wheels rotate together. Bearings (not shown) are contained within the wheel motors allow for rotation of the shafts. Many other variations are possible for driving the wheels, as for example, one or both shafts 79 could be driven by a torque transfer cable that extends from an electric motor over to shafts 79. Driving means for rotating wheels 80 is common in the art and will not be discussed in detail. Belts 62 are driven by a belt motor 105, shown in FIG. 3. The belt motor is an electric motor that is gear reduced to enable it to spin rear shaft 69 at the desired speed so that belts 62 achieve the desired surface speed for translating football 23. The belt motor is secured to side bracket 68 using a belt motor bracket 106, best seen in FIG. 9. The motor bracket is contemplated as being made from stamped metal, however, molded plastic could be used as well. Belt motor bracket fasteners 107 can be used to secure the belt motor bracket to side bracket 68 and in this way securing belt motor 105 to the side bracket. Drive mechanism to drive shafts are common practice and will not be described in detail. Alternatively, wheel motor 110 can be used to drive wheels 80 and belts 62 by the use of pulleys and belts or other energy transferring means. Since driving these types of mechanisms is common practice among those skilled in the art, they will not be described in detail. It should be well understood that there exist many different methods that are commonly used to drive belts 62 and wheels 80, therefore, the scope is not meant to be limited to the described of these common mechanical methods.

It is well-known that oval footballs can be thrown more accurately and further when they are thrown with one end first and the football is rotating about its axis from point to point, commonly referred to as a spiral pass. It is also well-known in the sport of American football that learning to catch a football that is thrown to the receiver as a spiral pass is a skill that requires practice. Part of the utility of launcher 10 is to teach a player to catch this type of pass. Therefore, launcher 10 is configured to enable it to throw an oval football into the air as a spiral pass. This requires the football to be at least partially oriented end to end with one end substantially pointing in the direction of wheel 80. Described in another way, in order for ball accelerator 81 to launch a spiral pass, the oval shaped football should be presented to ball accelerator 81 with one end of the football being pointed toward the wheels so that the football can be feed between the wheels to launch the football into the air. Therefore, launcher 10 needs to be capable of orienting footballs in the above described manner that are randomly thrown into collector 20. Orienting oval football 23 into this described position to enable a spiral pass to be thrown from the accelerator while at the same time minimizing jams in launcher 10 is challenging due to the oval shaped of football. Therefore, the examples presently contemplated identify a plurality of approaches used to orient an oval shaped football with a minimum amount of jamming in the machine and providing a high percentage of good quality spiral passes and a target collector 20 net that is chest high to facilitate good passing practice.

Referring again to the first example presently contemplated, the oval footballs coming from collector 20 will fall onto translator 60 in a number of different orientations. The translator is capable of receiving these footballs 23 and at least partially orienting them before they are presented to ball accelerator 81.

Figure 4:
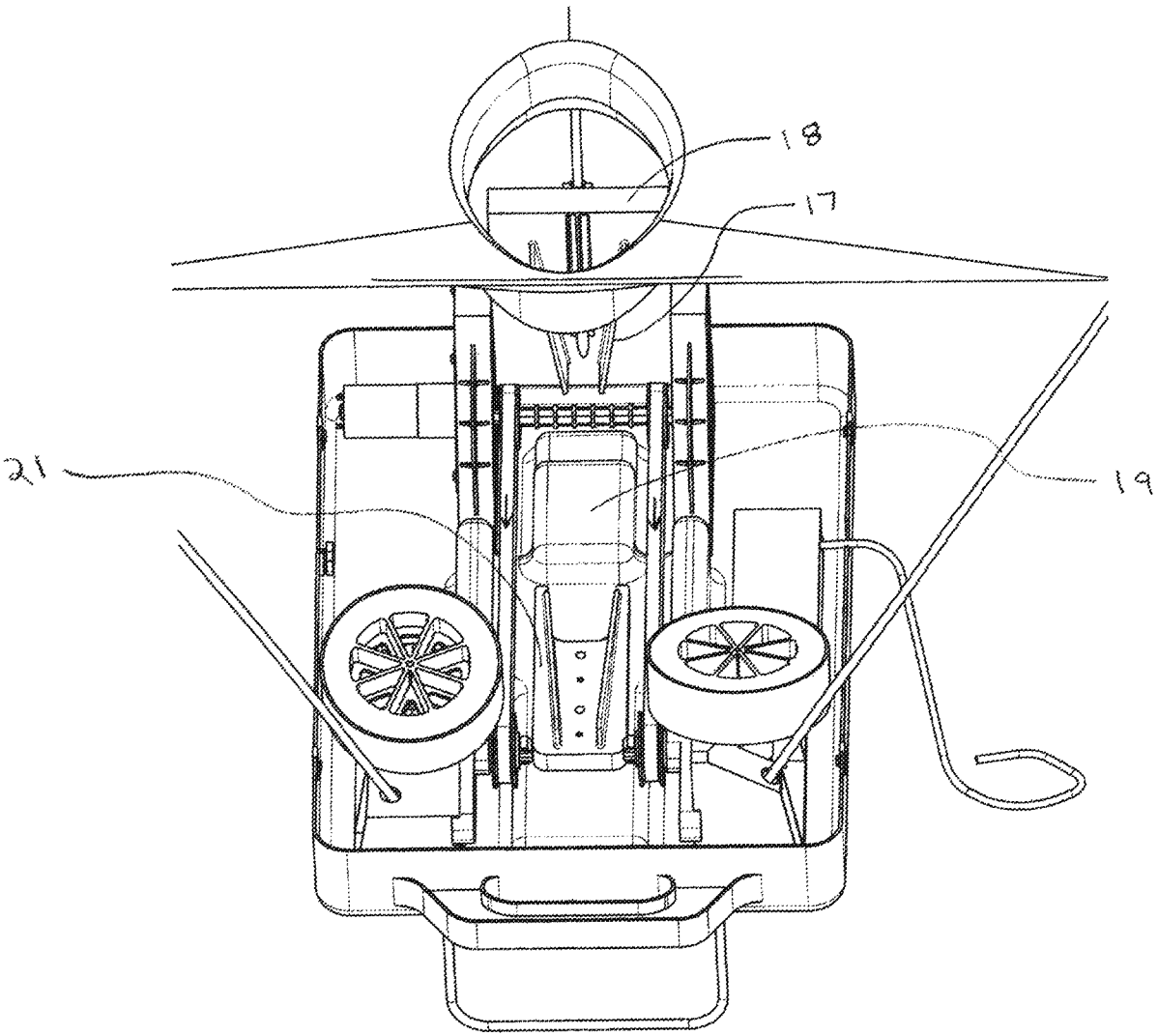
FIG. 4 is a front-top perspective view of the first example of the oval football receiving and launching machine with the cover omitted to show the mechanical features underneath the cover.
Figure 5:
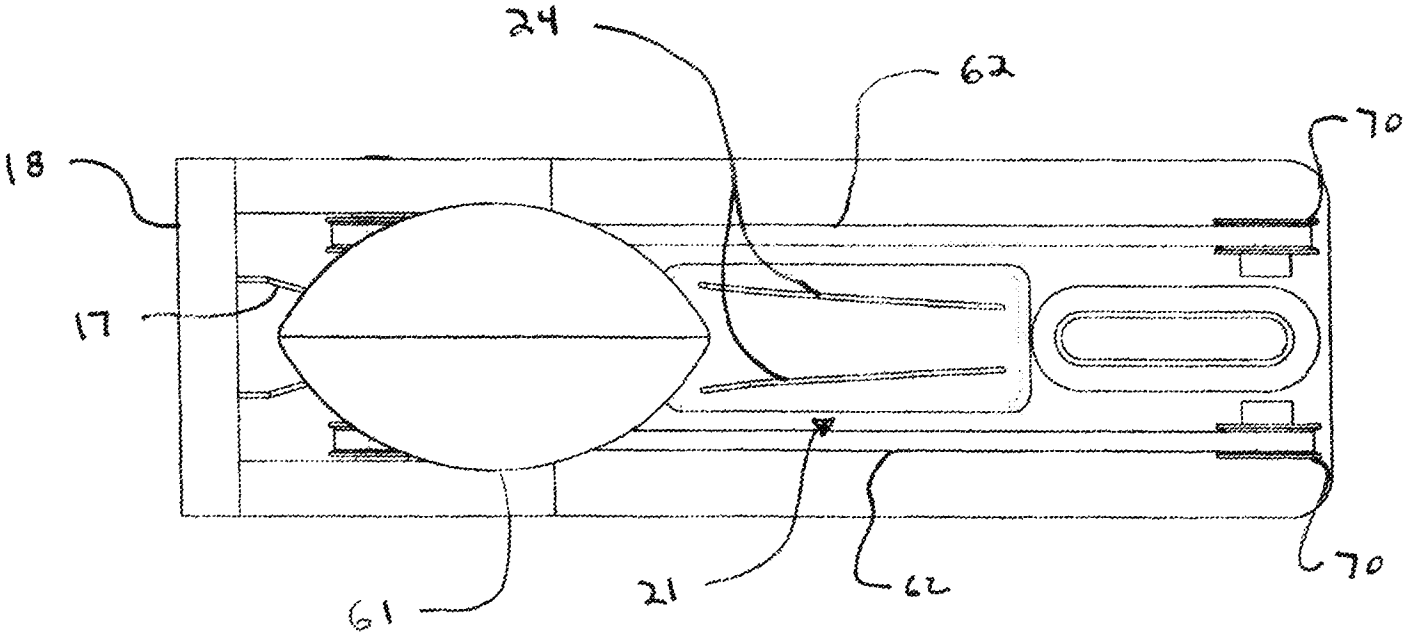
FIG. 5 is a top view of the first example of the oval football receiving and launching machine with the cover omitted to show the internal mechanical features.

This first example includes one or more ball guides to assist alignment and orientation of the football as it is presented to the ball accelerator. As best shown in FIG. 4, drop assist guide walls 17 are integrated as part of bracket 18 to help orient oval footballs that fall with their end pointing downward onto the belt. The guide walls are contemplated as being made from a stiff material, as for example metal or semi-rigid molded plastic or plastic sheet. As shown in FIG. 4, guide walls 17 are shaped such that the end of the guide walls closest to the exit of chute 76 have a wider space between the walls than the opposite end. The space is sufficient to receive a football end as shown in FIG. 5. Typically, if a football falls onto translator 60 when it is substantially pointing downward it will contact guide walls 17, however, not all footballs 23 will contact the guide walls. As belts 62 translate the football toward ball accelerator 81, guide walls 17 contacts the footballs of certain miss-orientated alignments and moves it more toward the desired orientation. As can be seen in FIG. 5, the back portion of the football will contact guide 17 in certain orientations, which will facilitate the football being at least partially aligned as belts 62 of translator 60 moves the football toward ball accelerator 81. In both cases described, as the football moves down and forward, the space between guide walls 17 decreases forcing the football to orient more as it moves toward ball accelerator 81 and into a position to be fully carried by the belts. Bracket 18 is mounted on base 102 using fasteners (not shown) that pass through the bottom of the base and into the bracket. Additional fasteners (not shown) connect bracket 18 to side brackets 68. The bracket can be made of a molded polymer, as for example nylon 6-6, or other materials that have sufficient rigidity and toughness to guide football 23 and are able to withstand falling footballs from collector 20 without damaging bracket 18 or guide walls 17.

Figure 6:
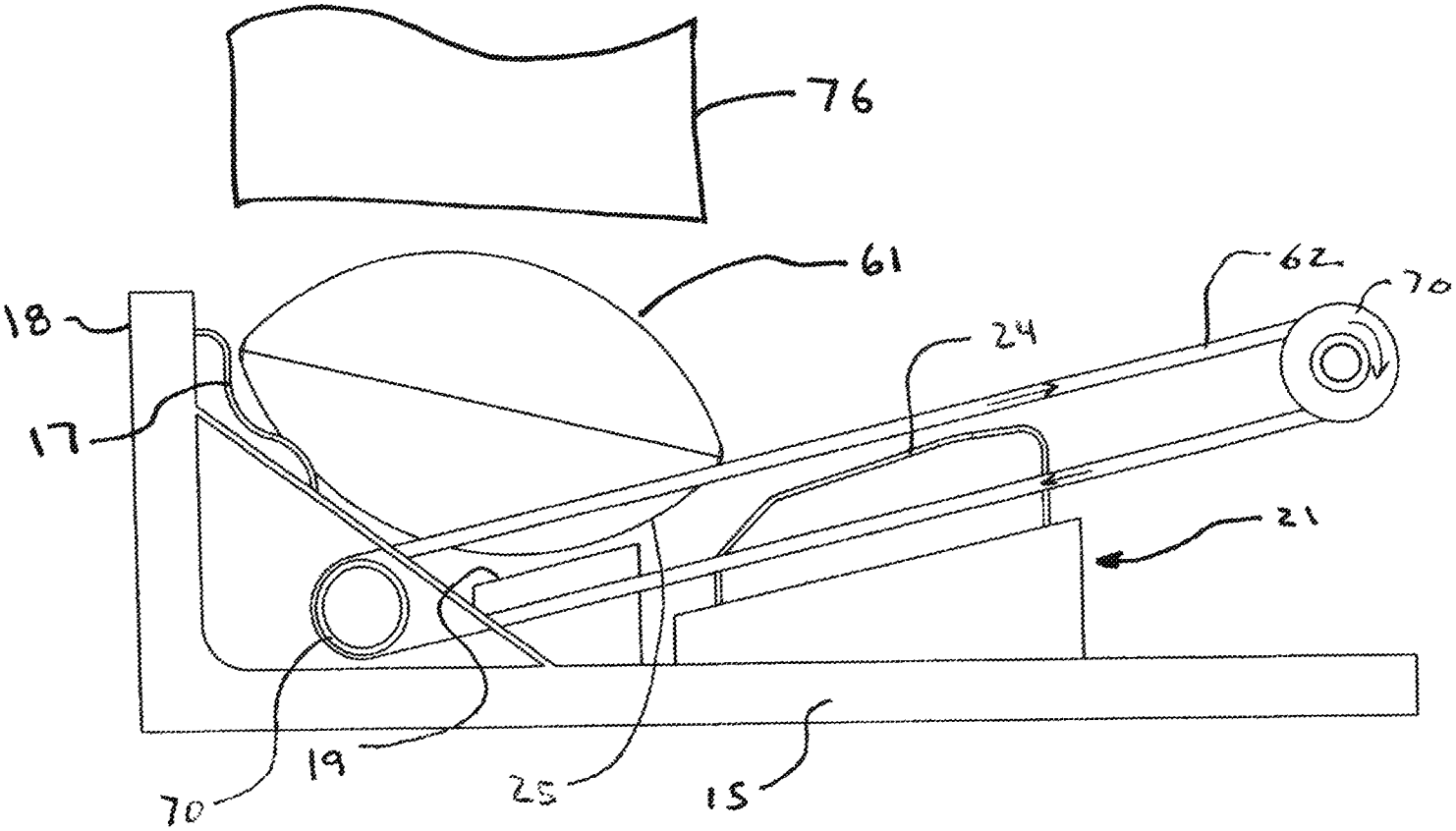
FIG. 6 is a side view of the first example of the oval football receiving and launching machine with many of the components omitted to make a simpler view.

Referring now to FIGS. 4 and 6, as the football moves from first position 61 toward ball accelerator 81, if it is miss-aligned it may contact an up-down alignment feature 19 that is best seen in FIG. 4. The height of the alignment feature is sufficient so that it will contact footballs that have either their leading end too far down below the top surface of belts 62 or the trailing end too far below the top surface of the belts 62. Described another way, if the football's front end, which is the end closest to ball accelerator 81, is pointing far downward or upward, the up-down alignment feature 19 will contact either the front end region of the ball or rear end region of the football respectively as the football is translated on belts 62 toward the ball accelerator. Therefore, up-down alignment feature 19 prevents a football from passing it while it rides on the belts of translator 60 moving toward ball accelerator 81 if the football is pointing either too high or too low on this portion of the trip between first position 61 and past alignment feature 19. This is achieved by the either the footballs leading end region contacting the top of alignment feature 19 or the trailing end region contacting the top of alignment feature 19 while it passes over the up-down alignment feature on the belts. When a ball contacts alignment feature 19, the ball is rotated into a substantially more aligned position relative to how it is resting on the belts. The goal is to have the football with the plane between the front end and rear end of the football to be approximately parallel to the top surface of the belts. If the football is already within an acceptable plane tolerance of the top surface of the belts, the football will not touch up-down alignment feature 19. It is contemplated that alignment feature 19 be integrated with base 102. However, the alignment feature could be a separate part made from a variety of semi-rigid or fully rigid materials. In addition, the alignment feature could be formed from thin wall sheet metal, plastic or other type of structural materials and could be shaped in a variety of configurations to accomplish the function of partially orienting footballs that are too far out of plane with the top of translator belts 62 from continuing that way to ball accelerator 81.

Referring now to FIG. 5. As the oval shaped football is translated on belts 62 that are strung around rear pulleys 70R and front pulleys 70F. The football moves from first position 61 toward ball accelerator 81. As the football travels forward, if it is miss-aligned so that the one end of the football is not pointing at a wheel gap 72, it may contact a side-to-side ball director 21 if it is not side to side oriented within the acceptable limits of ball accelerator 81 to ensure a good spiral pass is thrown by the ball accelerator. As best seen in FIG. 5, the space between ball director walls 24 of side-to-side ball director 21 are wider on the end closer to first position 61 and narrow closer to the ball accelerator. This is to enable side-to-side ball director 21 to receive the front end portion of a miss-aligned football where the football's front end is pointing in a direction other than between wheels 80. If the football is pointing in another direction, then ball director walls 24 of side-to-side ball director 21 may contact the front or rear portion of the football and direct the football into better alignment as it moves toward the ball accelerator. Therefore, side-to-side ball director 21 contacts side to side miss-aligned footballs in which the end to end orientation of the football is not pointing toward the space between wheels 80. It is contemplated that ball director 21 and ball director walls 24 would be integrated as one molded polymer part, as for example injection molded nylon. Alternatively, the ball director walls could be integrated as part of base 102 or be made from a variety of rigid materials, as for example thermoplastics or metals.

As shown best in FIGS. 3 and 6, ball translator 60 has belts 62 that are strung over rear pulleys 70R and front pulleys 70F and are spaced apart a distance less than the diameter of the football. A belt gap 71 between the belts allows a portion of the ball, referred to as a belly 25 of football 23 to rest between the belts without the football falling through the belts. Therefore, belts 62 form a type of spread support system for the football to be supported upon. This assists in aligning the side-to-side orientation of the football. The belt gap between belts 62 uses the weight of the football to urge the ball to alignment side to side and to maintain that alignment once achieved. As best shown in FIG. 4, belt gap 71 between the belts also provides access to the belly of the football for up-down alignment feature 19 and side-to-side ball director 21. Belts 62 are contemplated to be made from rubber or stranded rubber or plastic material. However, a variety of flexible materials could be used for the belts.

Figure 7:
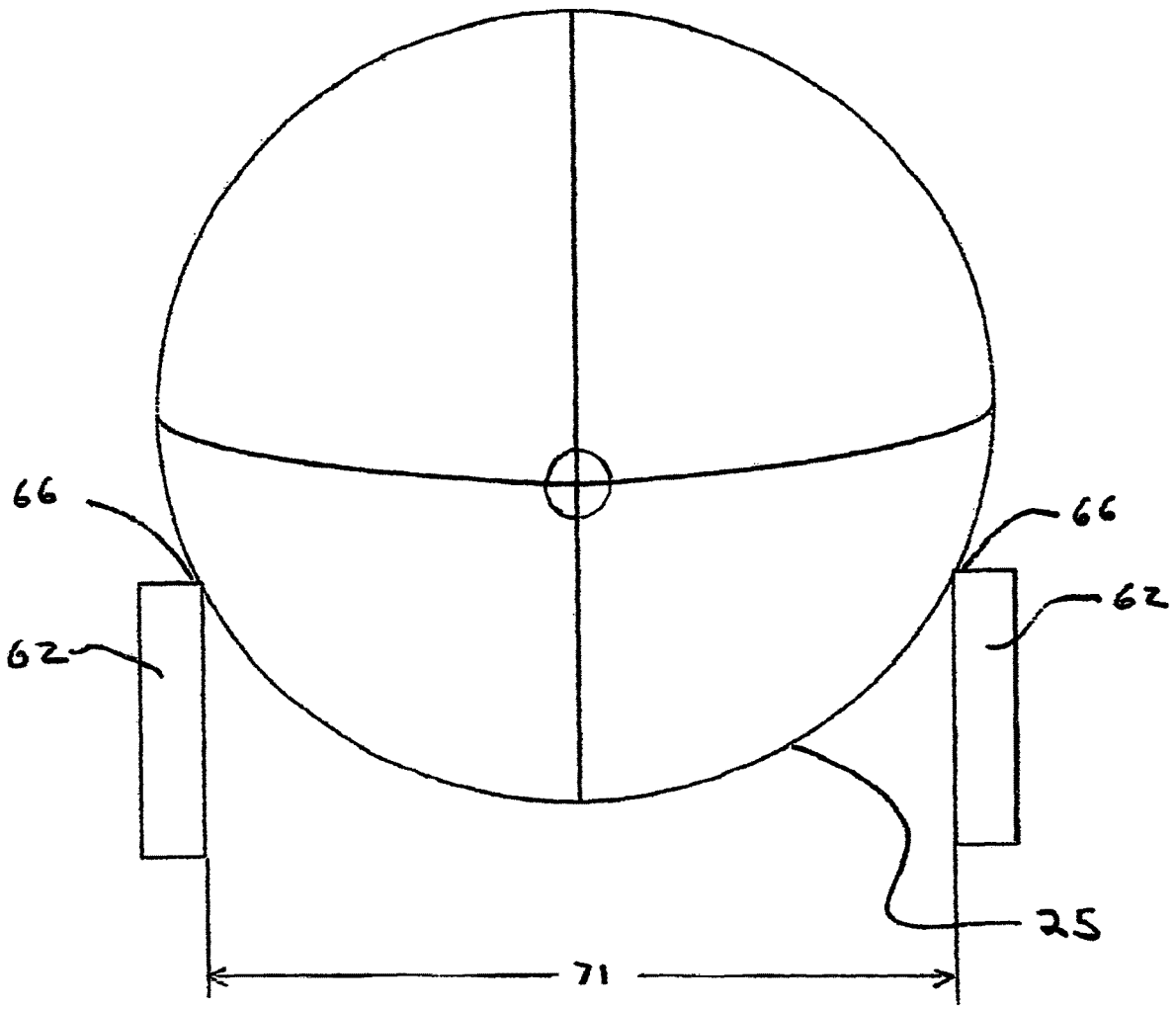
FIG. 7 is simplified front view displaying narrow belt spacing relative to the football.
Figure 8:
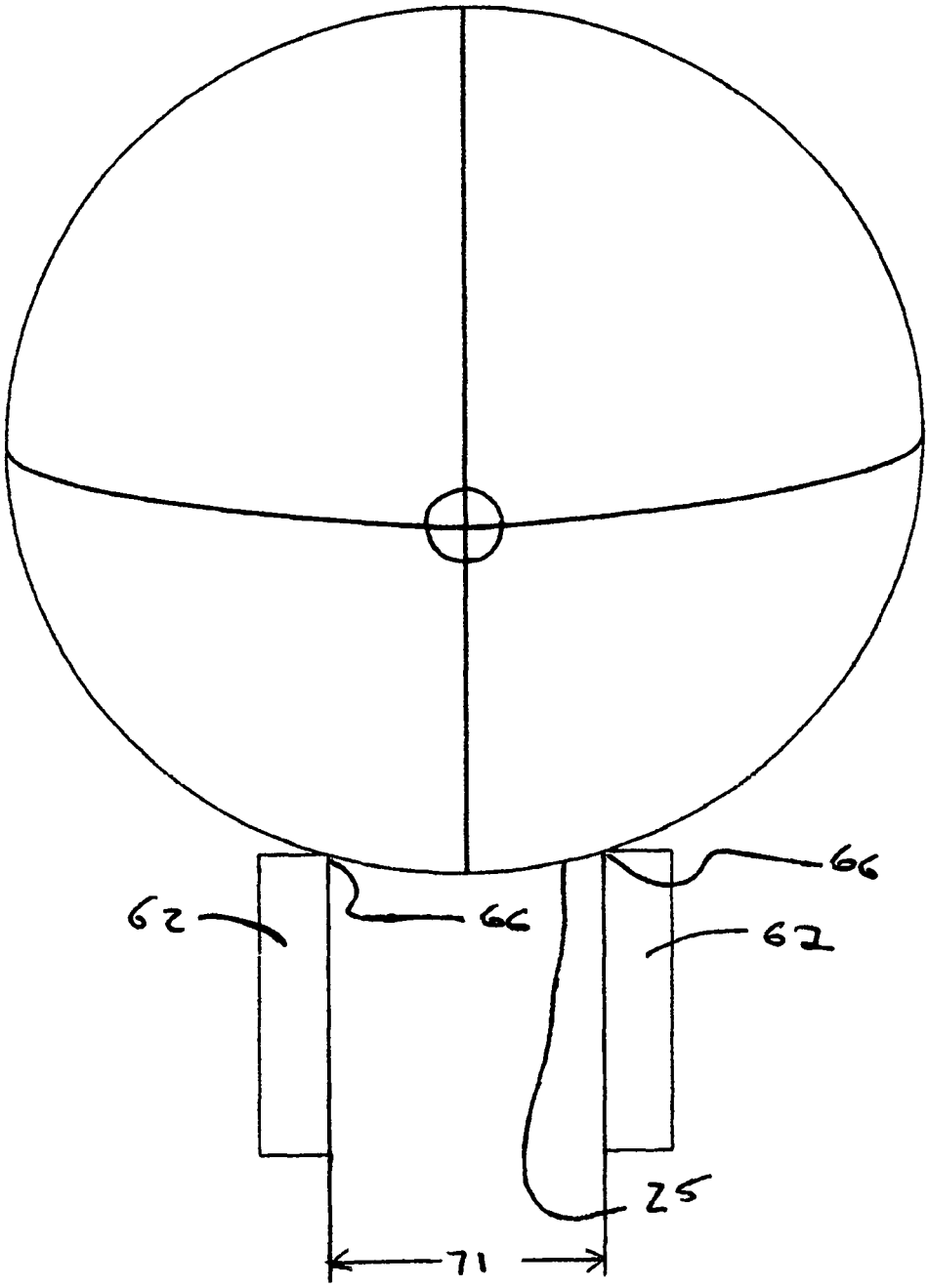
FIG. 8 is simplified front view displaying wide belt spacing relative to the football.
Figure 10:
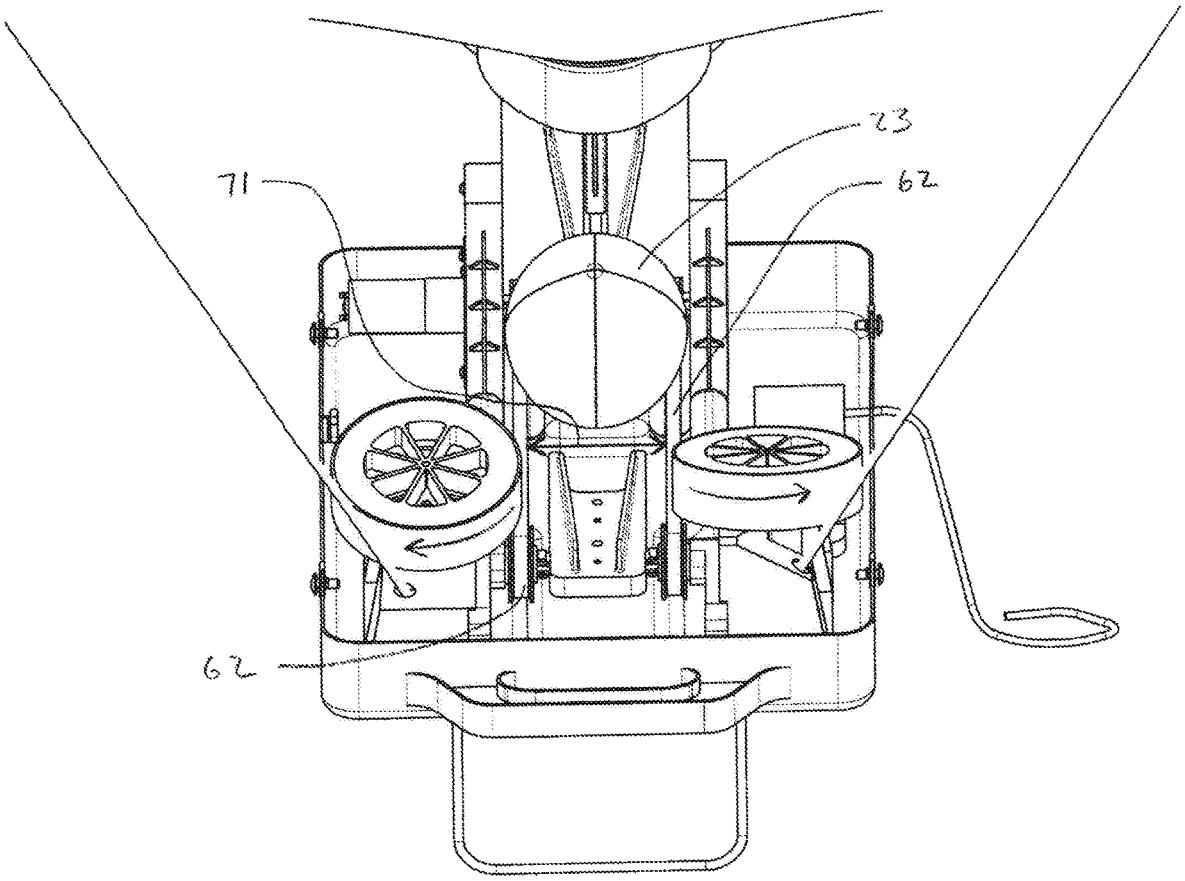
FIG. 10 is a top-front perspective view of the first example of the oval football receiving and launching machine with the cover omitted to show a miss-aligned football in the machine.

Referring now to FIGS. 9 and 10. Belt gap 71, a belt angle 160 and a belt speed 165 combine to create a ball orientation method in which miss-aligned oval footballs can be aligned. In FIG. 9, the oval football is on belts 62, however, in this figure, the front end of the oval football is too high above the belt for proper launching, forming ball angle 166 between the plane of the belts and the plane going through the two ends of the football. However, it is prevented from being transported all the way to wheels 80 in this position due to a combination of the effect on football 23 of belt angle 160, belt speed 165 and belt gap 71 between the belts causing the football to roll over backward. The speed of the belts accelerates the bottom of the football that is in contact with the belts when the football lands on belts 62 from collector 20 since belts 62 contact the football below the centerline of the ball. This acceleration produces a moment 170, shown in FIG. 9, that tends to cause the football to roll over backward. The amount of moment 170 required to cause the ball to roll over depends on belt angle 160 and belt gap 71. A steeper belt angle 160 will allow the oval football to roll over backward with less belt speed 165 and less ball angle 166. In addition, if belt gap 71 is wider and the football sits lower between the belts as shown in FIG. 7, either more belt speed 165, belt angle 160 or the combination of them will be required to cause the football to roll over backward for a given oval football ball angle 166. The opposite is true if belt gap 71 is narrower, as shown in FIG. 8. In this case, the narrower belt gap will cause the football to ride higher on belts 62 making it easier to roll over backward. After the oval football rolls over backward it will tend to land in first position 61, shown in FIGS. 6 and 11, with more of the football's belly 25 aligned between belts 62 in belt gap 71. This process may repeat a number of times with the oval football rolling over backward until ball angle 166 is small enough that it is an acceptable amount required to launch the oval football with the desired percentage of spiral passes.

Figure 12:
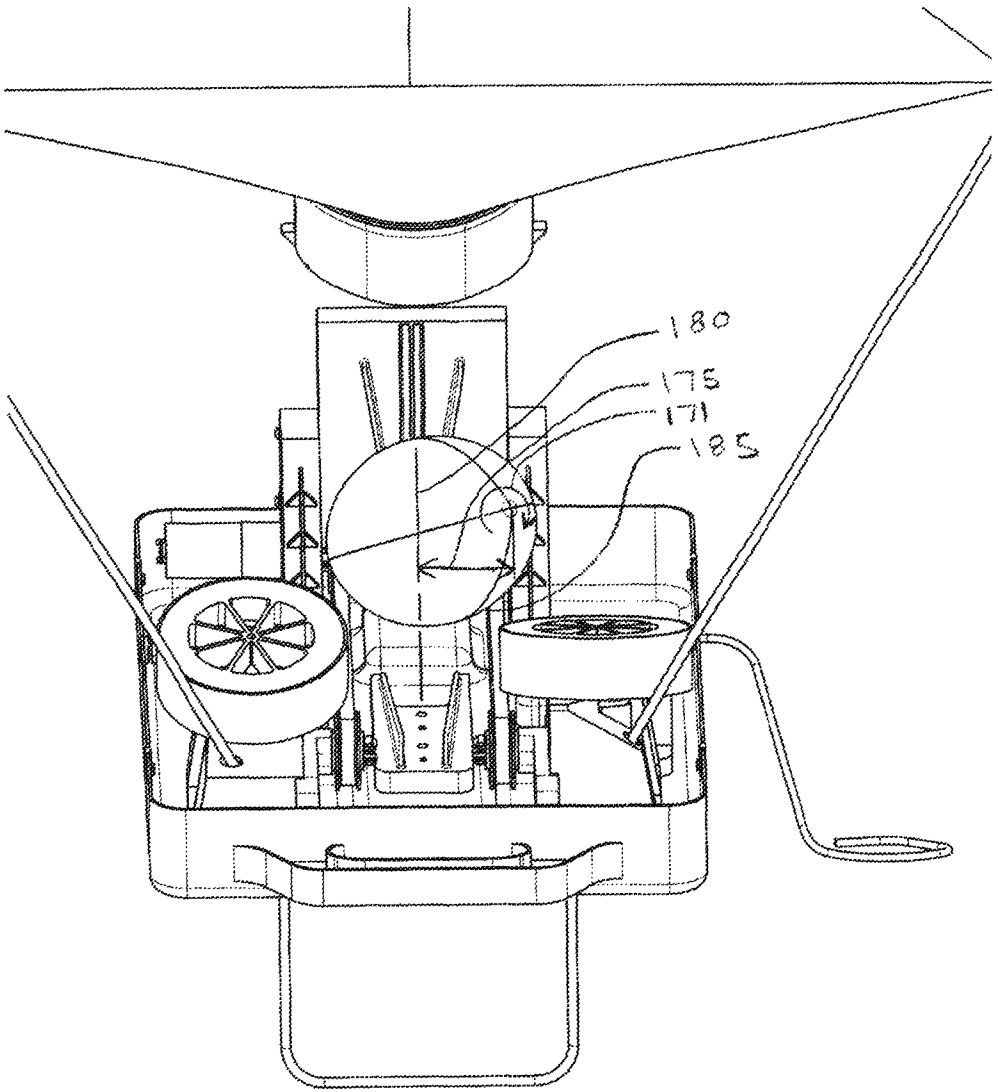
FIG. 12 is a front perspective view of the first example of the oval football receiving and launching machine with the cover omitted to show the moments on a miss-aligned football in the machine.
Figure 13:
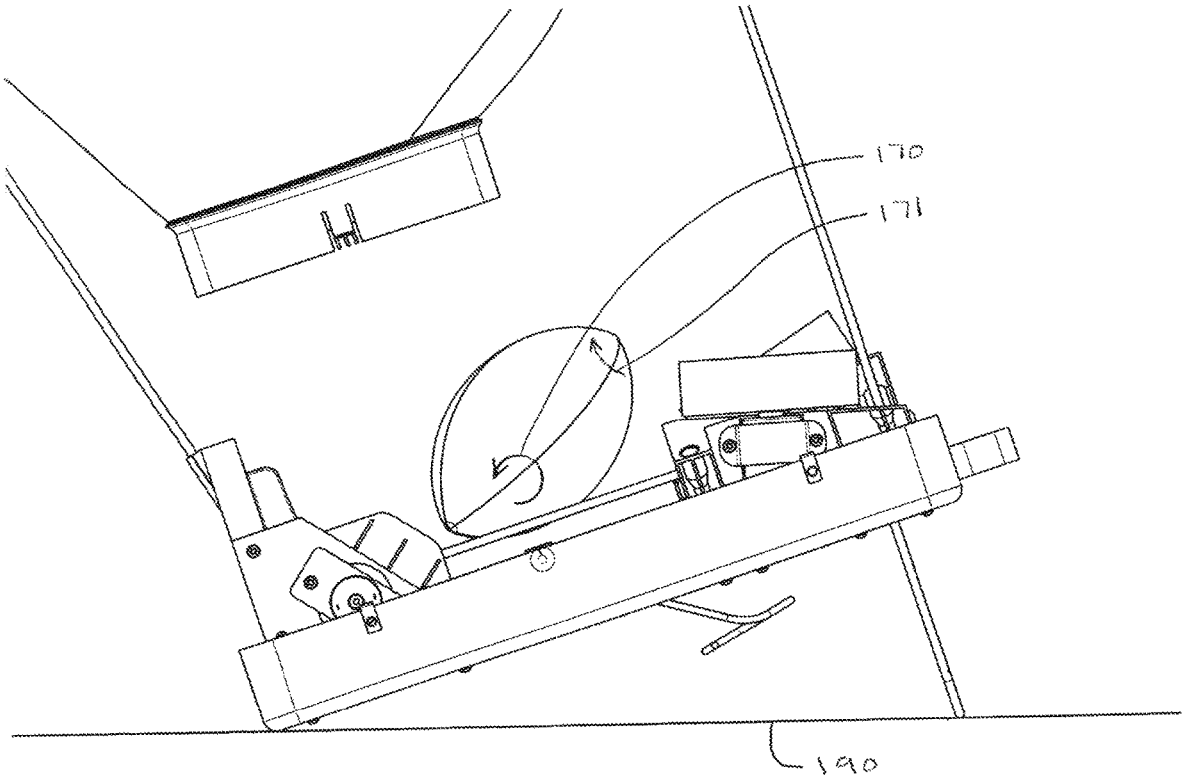
FIG. 13 is a side view of the first example of the oval football receiving and launching machine with the cover omitted to show the moments on a miss-aligned football in the machine.

FIG. 12 illustrates that oval football 23 can also be miss-aligned off to a side forming distance 175 from a centerline 180 and the center of the front end of the football. The centerline represents the center location between wheels 80. When the two ends of oval football 23 are not aligned with centerline 180, the contact between the football belly 25 and belt 62 at a tangent point 185 causes the front end of the football to rise creating a ball angle 166, shown in FIG. 9. This, combined with belt 62 accelerating the bottom portion of the oval football and ball angle 166 employing gravity effects cause a moment 170 which is a force acting on the ball that tends to roll the oval football backward, away from wheels 80, on the belts. In addition, in this case, belt gap 71 between the belts has an impact since a smaller belt gap will cause the ball to ride higher on the belts and will tend to cause the football to roll backward with less moment force required. In addition, this miss-aligned position of the football both with ball angle 166 and distance 175 from centerline 180 causes another rotational force on the oval football called an axis moment 171, shown in FIGS. 12 and 13. This moment is a force on the football that tends to rotate the oval football about its axis from end to end so that the football rolls down the belts, way from wheels 80. The oval football is prevented from rolling off the belts by cover walls 42 on cover 41 shown in FIG. 1. The oval football may repeatedly roll down the belts until both the side to side orientation illustrated by distance 175 and ball angle 166 are small enough to prevent the ball from rolling backward. In this way, the football's alignment with center line 180 is improved to improve the quality of the football thrown by wheels 80.

It should be understood that careful selection of belt gap 71, belt angle 160 and belt speed 165 can produce a football alignment orientation system that may not require the need for additional ball alignment features. However, additional alignment orientation mechanical features to assist in the alignment may be used.

Optimization of belt gap 71, belt angle 160 and belt speed 165 depend on the size and type of material of the oval shaped football that is desired to orient and launch in launcher 10. However, experimentation shows that there are relationships between each of these parameters and the time to launch a football once it is thrown into the machine, the distance the oval football will fly and the quality of a spiral achieved. For example, the data in the table below was created by varying belt gap 71 using a football made of foam that was a junior sized oval football with an approximate length of 210 mm and a diameter round the middle of the football of 122 mm. The sample size was 26 cycles through the launcher as defined by throwing the football into the launcher and measuring the time for the launcher to throw the football, the distance it went before hitting the ground and if it was a spiral thrown football or not. For each of the belt gap settings, this cycle was repeated 26 times and the average of these 26 samples is shown below. The % belt gap of ball diameter is defined as equal to belt gap 71 divided by the oval football diameter times 100. For the following experiment, the linear surface belt speed set to 305 mm per every 3 second and the belt angle 17.9 degrees from the surface launcher 10 was resting upon. All other parameters were held constant.

| % belt gap of ball diameter | Avg. Distance ball travels (ft) | Time to orient & launch ball after throw into collector (sec.) | Avg. frequency of spiral achieve: 1.0 = spiral 0 = not a spiral |
|---|---|---|---|
| 76 | 28.3 | 2.5 | .7 |
| 66 | 27.7 | 3.0 | 1.0 |
| 56 | 25.3 | 3.3 | .6 |
| 30 | 17.6 | 6.2 | .3 |

As can be seen from the data above, belt gap 71 has an impact on the distance thrown, the time to launch and the quality of the football that was thrown. As the belt gap gets smaller, less of belly 25 of oval football 23 can settle between the belts. Therefore, the belt gap has a reduced ability to align or orient miss-aligned oval footballs and less ability to maintain alignment during translation of the football from first position 61 to wheels 80, therefore, the frequency of spiral passes reduces. These general relationships apply to other football sizes and non-foam footballs as well. However, for each type and size of football, these dimensions would need to be adjusted to produce the desired results.

Another study focused on belt angle 160. In the table below is displayed the average of 26 cycles for each of the belt angles. The data in the table below was created by varying the belt angle using the same football as used for the belt gap study above, the football was made of foam that was a junior sized oval football with an approximate length of 210 mm and a diameter of 122 mm. All other parameters were held constant. As shown in the data table, increasing the belt angle increases the distance the oval football is thrown up to approximately 23 degrees. After that belt angle, further increases have a diminishing effect on the distance, but add an amount of time waiting for the oval football to be launched out of the machine. This is due to the number of times oval football rolls backward on belts 62 due to the moment forces of moment 170 and axis moment 171, shown in FIGS. 9 and 12. For this experiment the linear surface belt speed was set to 305 mm per every 3 seconds and the % belt gap of ball diameter was set to 76%. All other parameters were held constant. These general relationships apply to other football sizes and non-foam footballs as well. However, for each type and size of football, these dimensions would need to be adjusted to produce the desired results.

| Belt Angle 160 (deg) | Avg. Distance ball travels (ft) | Time to orient & launch ball after throw into collector (sec.) | Avg. frequency of spiral achieve: 1.0 = spiral 0 = not a spiral |
|---|---|---|---|
| 13.4 | 21.9 | 2.5 | 0.7 |
| 17.9 | 28.3 | 2.5 | 0.7 |
| 23.5 | 31.1 | 4.5 | 0.9 |
| 25.1 | 31.8 | 12.2 | 0.9 |

The linear surface belt speed 165 was also studied as part of this work to determine the effect of a speed range. The higher the belt speed the larger moment 170 and axis moment 171 are when the football contacts the belts and starts accelerating up to the belt surface speed. Therefore, the belt speed needs to be lower as belt angle 160 increases causing the pull of gravity downward on the belts or the belt gap 71 decreases causing the ball to ride higher on belts 62. If belt speed 165 is set too high for a given belt angle and belt gap the oval football will roll backward excessively on belts 62 and delay the launch of the oval football, making practice inefficient and slow. Some example belt speeds for a given belt gap 71 and belt angle 160 are provided using a junior size foam football that is 210 cm long and has a diameter of 122 mm. In these experiments the belt gap was set at 93 mm yielding a % belt gap of ball diameter of 76% and belt angle 160 is set at 23.5 degrees from the floor or surface launcher 10 was sitting upon. These general relationships apply to other football sizes and non-foam footballs as well. However, for each type and size of football, these dimensions would need to be adjusted to produce the desired results.

| Linear surface speed of belt (belt speed 165) | Avg. Distance ball travels (ft) | Time to orient & launch ball after throw into collector (sec.) | Avg. frequency of spiral achieve: 1.0 = spiral 0 = not a spiral |
|---|---|---|---|
| 305 mm/1.0 sec | N/A | Football rolled over backward excessively, not allowing sufficient launches. | NA |
| 305 mm/2.0 sec | 28.2 | 4.2 | 0.7 |
| 305 mm/4.0 sec | 28.8 | 4.8 | 0.8 |

Belt gap 71 and belt angle 160 combine to create a ball orientation method in which misaligned oval footballs can be aligned enabling launcher 10 to reduce jams, increase the distance a football is thrown, reduce the time required to orient the football and improve the percentage of spirals thrown. To illustrate these advantages over what was previously known, an additional experiment was completed with belt gap 71 being eliminated by replacing belts 62 with a single wide flat belt and setting belt angel 160 to zero degrees, making it parallel with the ground in the first case and setting it to 17.9 degrees in the second case. The same football was used as in the experiments above, a junior size foam football that is 210 cm long and has a diameter of 122 mm. As can be seen in the table of data below, the impact of not having belt gap 71 combined with belt angle 160 is significant, resulting in an average distance the football traveled that is much lower, the time to launch the football with a belt angle of 17.9 degrees being much longer and in both cases a much lower percentage of spiral passes due miss-oriented footballs being presented to throwing wheels 80. The sample size was 26 cycles at each setting. These general relationships apply for other football sizes and non-foam footballs as well. However, for each type and size of football, these dimensions would need to be adjusted to produce the desired results.

| % belt gap of ball diameter | Belt Angle 160 (deg) | Linear surface speed of belt (belt speed 165) | Avg. Distance ball travels (ft) | Time to orient & launch ball after throw into collector (sec.) | Avg. frequency of spiral achieve: 1.0 = spiral 0 = not a spiral |
|---|---|---|---|---|---|
| 0 - flat belt without space | 0 | 305 mm/3.0 sec | 16.6 | 2.9 | 0.1 |
| 0 - flat belt without space | 17.9 | 305 mm/3.0 sec | 17.1 | 32.1 | 0.1 |

Referring now to FIG. 3, wheel gap 72 is sized smaller than the outside diameter of the oval football that is to be thrown by launcher 10. This results in wheels 80 squeezing oval football 23 between the wheels while accelerating the football into the air. The amount of football diameter reduction or squeeze is defined by the following equation; % squeeze of ball diameter=1-wheel gap length/ball diameter× 100. The amount of squeeze of the football diameter through wheel gap 72 impacts the average distance a football will fly and the quality of the pass thrown by the machine. The friction between wheels 80 and the amount of time the football is in contact with the wheels increases with the increase in squeeze on the football. Experimental data in the table below was completed using a foam junior size football with a length of 210 cm and a maximum diameter of 122 cm. For this size and type of oval football, the following data was collected showing the impact of the squeeze of the oval football on the average distance thrown and the quality of the pass thrown. The sample size was 26 cycles at each setting for wheel gap 72. All other variables were held constant.

| % squeeze of ball diameter going through wheel gap 72. Mathematically defined as: squeeze of ball = 1-wheel gap/ball diameter × 100 | Avg. Distance ball travels (ft) | Avg. frequency of spiral achieve: 1.0 = perfect 0 = not a spiral |
|---|---|---|
| 17% | 28.3 | 0.7 |
| 22% | 36.5 | 0.9 |
| 25% | 45.0 | 1.0 |
| 30% | 49.1 | 1.0 |
| 34% | 43.7 | 0.8 |
| 39% | 43.0 | 0.5 |
| 43% | 41.3 | 0.4 |

Figure 14:
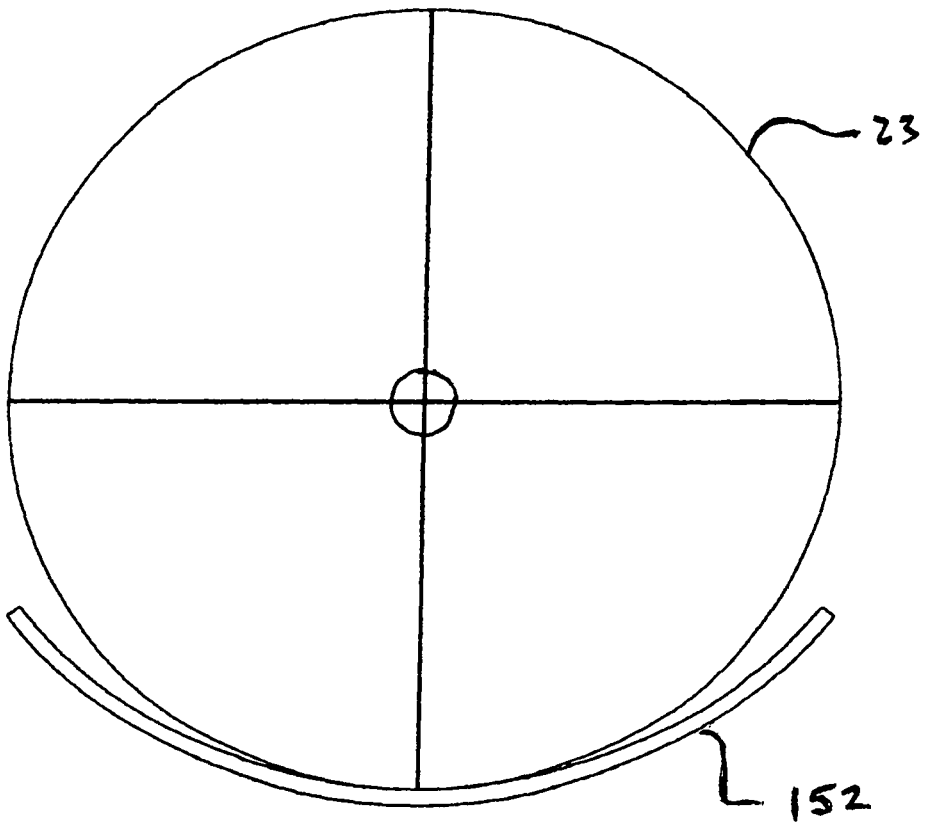
FIG. 14 is a front-top perspective view of a second example of the oval football receiving and launching machine with the cover omitted to enable a clear view of the mechanical features underneath the cover.

In a second example presently contemplated, shown in FIG. 14, belts 62 are spaced apart by belt gap 71 and are used to support, transport and orient oval football 23 from the first position 61 to wheels 80. Belts 62 and belt gap 71 form a spread support system for supporting the football. In this example, belt gap 71 is used to orient the oval football. The oval football can fall on the belt in any orientation at the first position 61 and be oriented by the belt gap 71 in combination with belt angle 160, shown in FIG. 9, and belt speed 165. Cover 41 is not shown to allow visibility to the internal mechanical features. However, cover 41 is included in this example and cover walls 42 prevent oval football 23 from falling off of the belts.

Figure 15:
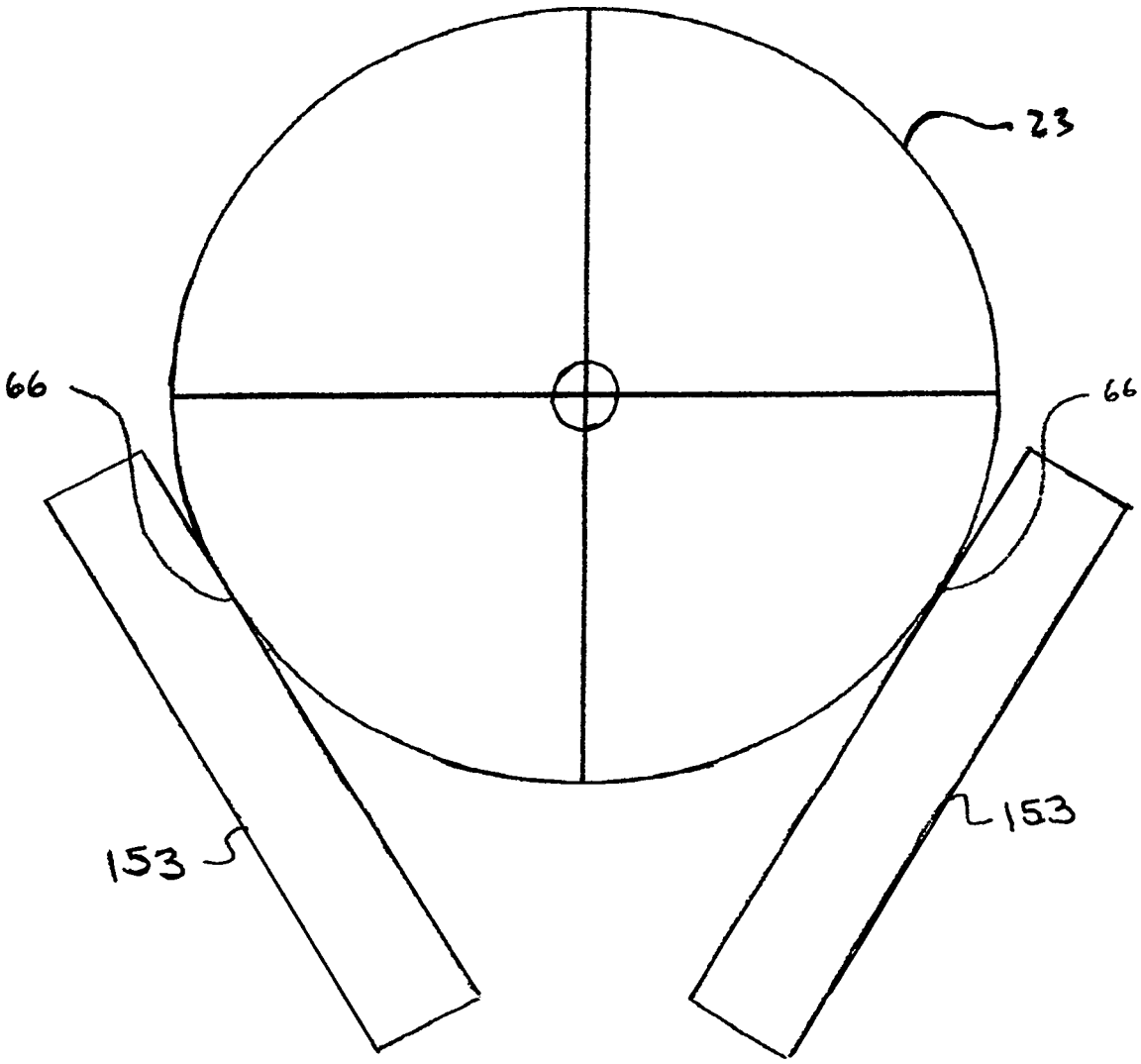
FIG. 15 is a simplified front view of a cross-section through the top of the belt only of a third example of the oval football receiving and launching machine.

In a third example as currently contemplated, belts 62 can be replaced by a shaped conveying system as for example a U-shaped belt 152 shown in FIG. 15. In this figure, the other features of launcher 10 have been hidden to emphasize the U-shaped belt that is shaped in a manner that helps orient and keep the orientation of the oval football 23 as it is moved toward the ball accelerator. As the football is translated on the U-shaped belt moving toward wheels 80, gravity acts on the weight of the football to pull football belly 25 down toward the bottom of the U-shaped belt and in this way orients the football to be launched by wheels 80. In addition, the U-shaped belt, when combined with belt angle 160 and belt speed 165 will also will generate moment 170 and axis moment 171 to cause significantly miss-aligned footballs to roll over backward down the belt to re-align and re-orient themselves.

It should be understood that there exist many different configurations of shaped conveying systems that can be shaped in a manner to urge belly 25 of football 23 to align with the belt 152 to orient and maintain alignment of the oval football while it is being translated from first position 61 to the launching wheels 80.

Figure 16:
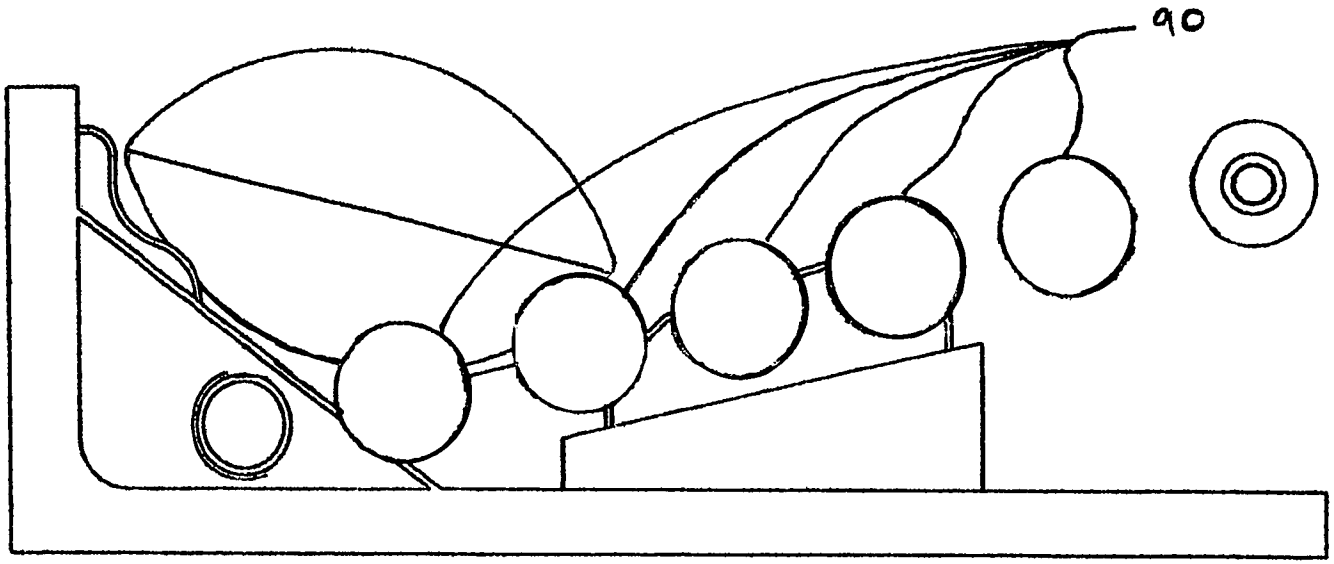
FIG. 16 is a simplified front view of the belt portion of a fourth example of the oval football receiving and launching machine having two flat belts in a V-shape.

In a fourth example as currently contemplated, shown in FIG. 16, two flat belts 153 that are arranged relative to each other forming a V-shape that also provides another type of spread support system for the belly 25 of the oval football. This provides line contact points 66 as shown and has the same oval football 23 orientation capability as spread apart belts 62, functioning in the same manner as described for the spread apart belts 62 in the first example. This example also enables flat belts 153 to transport the oval football from first position 61 to launching wheels 80 and maintain the orientation of the football.

Figure 17:
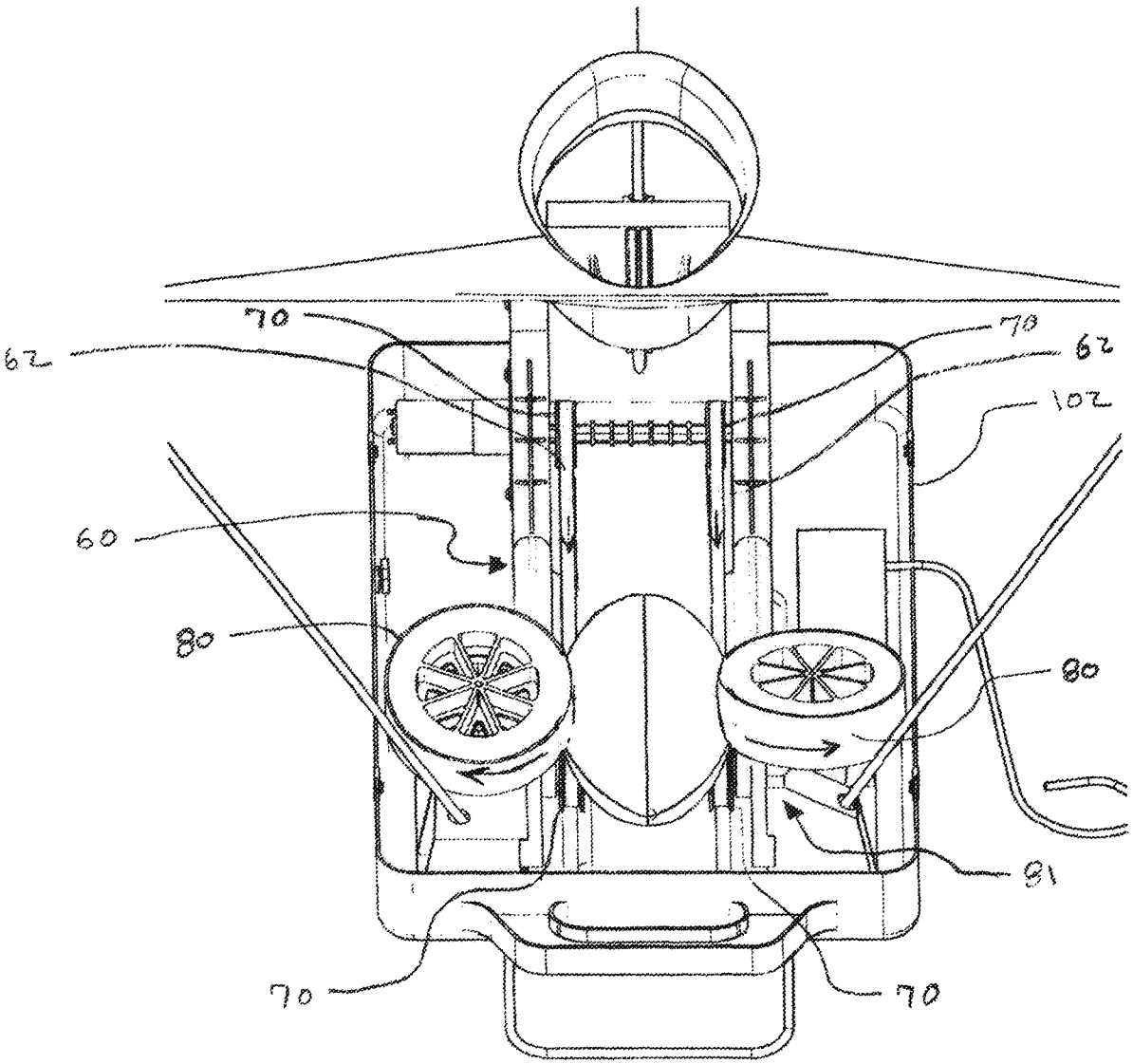
FIG. 17 is a simplified side view of a fifth example of the oval football receiving and launching machine displaying a translator consisting of rollers.
Figure 18:
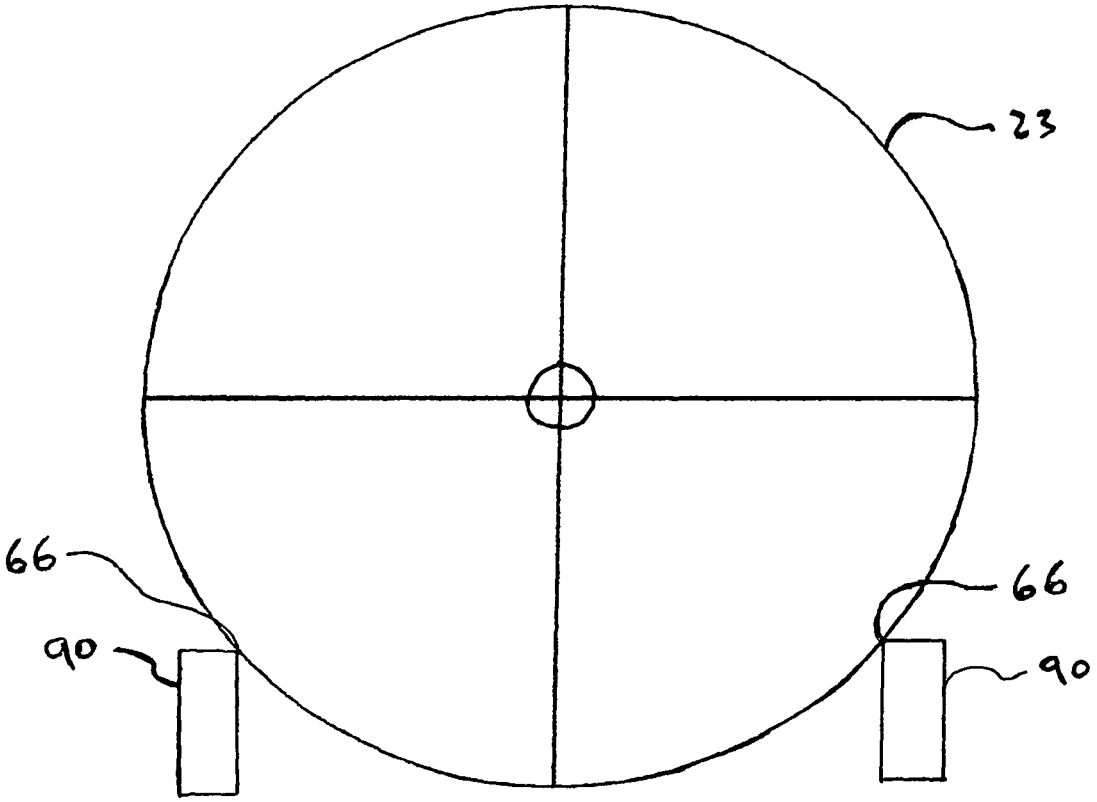
FIG. 18 is a simplified front view of the fifth example of the oval football receiving and launching machine displaying a translator consisting of rollers.

In a fifth example as currently contemplated, shown in FIGS. 17 and 18, belts 62 are replaced by a plurality of small rotating roller wheels 90 that are aligned and spaced apart by a roller gap 92, forming yet another spread support system for the belly 25 of football 23. The roller wheels contact belly 25 of football 23 at line contact points 66. Roller wheels 90 are driven by a motor to allow the football translate over rotating rollers up an inclined roller angle 93. The connection of the motors and drive system to the rollers can take many forms and these type of mechanical rotational systems are common practice and therefore will not be described in detail. The roller wheels are inclined on the roller angle and rotate as shown in FIG. 17 to assist in aligning miss-aligned oval footballs using the same principals as described in the spread apart belt system of example 1.

While the above description contains many specificities, these should not be construed as limitations on the scope, but rather as an exemplification of several examples thereof. Many other variations are possible. Accordingly, the scope should be determined not by the examples illustrated, but by the appended claims and their legal equivalents.

What is claimed is:

1. An oval football receiving and launching machine comprising:

a collector with walls that form a structural shape having a U-shaped receiving end with a first width for receiving a football and having a second funnel shaped width near a collector exit end to funnel said football received at said U-shaped receiving end to said collector exit end;

a ball translator including at least two support belt portions for receiving said football from said collector exit end of said collector and delivering said football along a linear inclined ramp trajectory set at a constant angle for each of said support belt portions to the end of said ball translator, said at least two support belt portions having belts that are separated for a distance for straddling a first belly portion of said football between said belts, wherein said straddling of said first belly portion of said football obstructs lateral movement of said football, wherein said constant angle causes said football to settle into said straddling of said first belly portion so that a ball angle is aligned with said constant angle of said linear inclined ramp trajectory for each of said at least two support belt portions;

a football accelerator receiving said football from said ball translator and configured to launch said football into the air having a flight path in a direction of said liner inclined ramp trajectory;

a cover overlying said football accelerator and said ball translator, said cover including a wall guide portion for preventing said football from falling from said at least two support belt portions before said football accelerator receives said football, wherein said cover includes an opening through which said football accelerator launches said football; and a motor configured to operate said football accelerator.

2. The football receiving and launching machine of claim 1 further comprising one or more drop assist guide walls that orient said football that falls with a front or rear end portion pointing downward onto said ball translator.

3. The football receiving and launching machine of claim 2 wherein said drop assist guide walls are spaced at a relatively greater distance apart at a first end in proximity to said collector and at a relatively shorter distance apart at a second end in proximity to said ball translator.

4. The football receiving and launching machine of claim 1, further comprising an up-down alignment feature configured to contact a top portion of a leading end or a trailing end of said football for rotating said football into an aligned position.

5. The football receiving and launching machine of claim 1 further comprising ball guides configured to align said football along said inclined path of said translator, wherein at least one of said ball guides is positioned under a top surface of said support belt portions, said guide is configured to contact one or more front or rear portions of said football on said linear inclined path if the front or rear portion of said football extends below said top surface of said support belt portions.

6. The football receiving and launching machine of claim 1 wherein said ball translator has one or more side-to-side ball directors.

7. The football receiving and launching machine of claim 6 wherein said side-to-side ball director is configured to contact said football to align it in a direction having its leading end pointing toward said accelerator.

8. The football receiving and launching machine of claim 1 wherein said collector includes a net and a support structure for supporting said net.

9. The football receiving and launching machine of claim 1 further comprising a cover that is over said ball translator and is configured to prevent the football from falling off of said translator.

10. An oval football receiving and launching machine comprising:

a collector having a structure with a U-shaped sidewall section with a first opening to receive a football thrown into said collector and a second opening that is smaller than said first opening having a width at least slightly larger than said football at an exit end near the bottom of said collector to allow said football to exit said collector;

a ball translator including at least two support belt portions for receiving said football from said exit end of said collector and delivering said football along a linear inclined ramp trajectory set at a constant angle for each of said support belt portions to the end of said ball translator, said at least two support belt portions are separated for a distance for straddling a first belly portion of said football between said at least two support, belt portions, wherein said straddling of said first belly portion resists lateral movement of said football, wherein said constant angle causes said football to settle into said straddling of said first belly portion;

a football accelerator receiving said football from said ball translator and configured to launch said football into the air having a flight path in a direction of said linear inclined ramp trajectory; and a motor configured to operate said football accelerator.

11. The football receiving and launching machine of claim 10 further comprising one or more ball guides that have structural features that contact footballs that are misaligned where the length of said football is not aligned with said linear inclined ramp trajectory on said ball translator in an attempt to better align said football with said ball translator.

12. An oval football receiving and launching machine comprising:

a collector having a structure with sidewalls forming a bounded area with a first opening to receive a football thrown into said collector and a second opening that is smaller than said first opening and at least slightly wider than said football at the bottom of said collector to allow said football to exit said collector at an exit end;

a ball translator including at least two support belt portions for receiving said football from said exit end of said collector and delivering said football along a linear inclined ramp trajectory set at a constant angle for each of said support belt portions to the end of said ball translator, said at least two support belt portions separated for a distance for straddling a first belly portion of said football between said at least two support belt portions, wherein said straddling of said first belly portion of said football obstructs lateral movement of said football, wherein said constant angle causes said football to settle into said straddling of said first belly portion so that a ball angle is parallel to the constant angle of said linear inclined ramp trajectory; said translator is configured to roll said football at least partially down said linear included ramp trajectory if said football is in a misaligned position where the length of said football is not aligned with said linear inclined ramp trajectory on said ball translator;

a football accelerator having two wheels spaced apart less than the diameter of said football, said wheels spin in opposite directions to launch said football into the air having a flight path in a direction of said linear inclined ramp trajectory and said two wheels arranged to receive said football from said translator; and a motor to operate said football accelerator.

* * * * *